US006302084B1

(12) United States Patent
Kamimura et al.

(10) Patent No.: US 6,302,084 B1
(45) Date of Patent: Oct. 16, 2001

(54) METHOD OF CONTROLLING THROTTLE VALVE OF ENGINE AND CONTROLLER

(75) Inventors: Yasuhiro Kamimura, Hitachinaka; Yasushi Sasaki, Urizura-machi; Norio Tomita, Hitachinaka, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/446,946

(22) PCT Filed: Apr. 14, 1999

(86) PCT No.: PCT/JP99/01988

§ 371 Date: Dec. 30, 1999

§ 102(e) Date: Dec. 30, 1999

(87) PCT Pub. No.: WO99/53182

PCT Pub. Date: Oct. 21, 1999

(30) Foreign Application Priority Data

Apr. 14, 1998 (JP) ..... 10-103109

(51) Int. Cl.[7] ..... F02D 9/02; F02D 9/10

(52) U.S. Cl. ..... 123/399; 123/361

(58) Field of Search ..... 123/399, 361

(56) References Cited

U.S. PATENT DOCUMENTS 6,034,500 * 3/2000 Nagase et al. ..... 123/399
6,123,056 * 9/2000 Shimada et al. ..... 123/399
6,152,108 * 11/2000 Adachi et al. ..... 123/399

FOREIGN PATENT DOCUMENTS 56-37414 8/1981 (JP) .
58-133447 8/1983 (JP) .
07-97959 4/1995 (JP) .
7-332136 12/1995 (JP) .
8-144820 6/1996 (JP) .
9-317538 12/1997 (JP) .
10-47135 2/1998 (JP) .
10-89140 4/1998 (JP) .

* cited by examiner

*Primary Examiner*—Erick Solis
(74) *Attorney, Agent, or Firm*—Crowell & Moring LLP

(57) ABSTRACT

A throttle valve control apparatus of an engine is constructed so that the poorer the response of the throttle valve, the larger the value of a control signal given as a control signal for opening of the throttle valve, whereby the speediness of control and response of the throttle valve are improved. The engine throttle valve control apparatus has means for comparing a target opening which is a control target of the throttle valve and a real opening which obtained by a sensor or the like, and obtaining a corrected target opening of the throttle valve by a map or computing, corresponding to a difference obtained as the result of the comparison.

14 Claims, 5 Drawing Sheets

(A) T1 ms OR MORE PASSED AFTER TARGET OPENING STARTING (B) TARGET OPENING+B deg<REAL OPENING (OPENING DIRECTION),
TARGET OPENING−B deg>REAL OPENING (CLOSING DIRECTION)

METHOD OF CONTROLLING THROTTLE VALVE OF ENGINE AND CONTROLLER

TECHNICAL FIELDS

The present invention relates to a control method and control apparatus of a throttle valve used for an internal combustion engine for a vehicle, etc.

BACKGROUND OF THE INVENTION

JP B 56-37414 discloses a control apparatus of a throttle valve which calculates a target opening of the throttle valve on the basis of engine speed and required engine torque, and controls so that a real throttle valve opening becomes a target opening.

Further, JP A 7-332136 discloses a throttle valve control apparatus of an internal combustion engine, which is provided with a throttle valve driving means for driving a throttle valve inserted in an engine intake system, a target opening setting means for setting a target opening of the throttle valve, a throttle valve opening detecting means for detecting an opening of the throttle valve, and an opening-closing control means computing a feedback control quantity including a proportional part using a difference between a target opening set by the target opening setting means and a detection opening detected by the throttle valve opening detecting means, driving the throttle driving means on the basis of the calculation result and effecting feedback control so as to cause the throttle valve to approach the target opening, wherein a proportional part gain changing means is provided in which a gain relating to the proportional part is made larger as the above-mentioned difference becomes smaller.

Still further, JP A 8-144820 discloses a throttle valve control apparatus of an internal combustion engine, which obtains a target opening of a throttle valve provided in an intake passage of the internal combustion engine mounted on a vehicle on the basis of required engine torque calculated according to engine speed and various conditions of the vehicle and electrically controls so that a real throttle valve opening becomes the above-mentioned target opening, and which is characterized by comprising an intake pressure detecting means for detecting intake pressure in the intake passage, a target intake pressure computing means for computing a target intake pressure in the intake passage according to the engine speed and required engine torque, and a correcting means for comparing the above-mentioned target intake pressure and a detection intake pressure and correcting the above-mentioned target opening according to the result.

Those official publications disclose the proportional part gain changing means or means for improving the response of the throttle valve by correcting an target opening calculated by an engine control unit itself.

However in the case of these methods, since motor driving duty is calculated using a certain constant fixed for operation of the throttle valve, the overall response is improved but an influence on the response of the throttle valve due to external or secular change or manufacturing variations in the products has not been improved as yet.

DISCLOSURE OF THE INVENTION

An object of the present invention is to provide a control method and control apparatus of a throttle valve of an engine which is able to reduce an influence on response of the throttle vane due to secular change or manufacturing variations in products, and attain an excellent response.

According to an aspect of the present invention, a reference target opening of the throttle valve set according to operational conditions of the vehicle and a real opening of the throttle valve are compared. A correction quantity for correcting the reference target opening is obtained, corresponding to the difference obtained as a result of the comparison. A target opening corrected to have a larger value than the reference target opening is set on the basis of the correction quantity.

Since the target opening corrected on the basis of the correction quantity is set a value larger than the reference target opening of the throttle valve, it is possible to improve a response speed of the throttle valve by controlling the throttle valve with a control signal generated on the basis of the corrected target opening.

Preferably, every time the reference target opening is changed, the correction quantity of the target opening is reset in turn according to difference between a real opening and the changed reference target opening.

Further, preferably, the correction quantity of the target opening can be obtained as a value of the difference multiplied by a constant. The constant is set a larger value as the difference becomes smaller. That is, the smaller the difference, the larger the set correction quantity of the target opening.

Further, preferably, when any one of a time having passed from the time the target opening is set, an overshoot quantity of a real opening to the reference target opening and a difference between the corrected target opening and the real opening reaches a predetermined value or more, the corrected target opening is set as the reference target opening.

Further, preferably, when a reference target opening signal was changed to a new reference target opening signal during opening control based on the corrected target opening, the corrected target opening is canceled, a new corrected target opening is set based on a difference between the new reference target opening and a real opening.

Further, preferably, the reference target opening is given from an engine control unit, and when the reference target opening changes, the corrected target opening is set.

Further, preferably, a suitable correction quantity of the target opening is selected from a plurality of predetermined values according to a difference between the reference target opening and a real opening.

According to another aspect of the present invention, a control apparatus of an throttle valve of an engine is provided with a reference target opening setting section outputting an opening of the throttle valve, set according to conditions of the engine as a reference target opening, a real opening detecting section detecting a real opening position of the throttle valve and outputting it, and a control target opening setting section computing a control target opening according to a difference between a reference target opening outputted by the reference target opening setting section and a real opening outputted by the real opening detecting section. The control target opening setting section has a target opening correction quantity operation section computing a correction quantity for correcting the reference target opening according to a difference between the reference target opening and the real opening.

Preferably, the above-mentioned control target opening setting section further has a corrected target opening operation section computing a corrected target opening from the computed correction quantity and a real opening.

Further, preferably, the above-mentioned control target opening setting section has a control target opening operation section selecting which to take a target opening as a control target opening or to take a reference target opening as a control target opening, in addition to the corrected target opening operation section.

Preferably, at least one part of the control target opening setting section is composed of an arithmetic program stored in a memory of a microcomputer for controlling an engine.

Further, preferably, at least one part of the control target opening setting section is composed of an arithmetic program stored in a memory of a microcomputer for controlling a throttle valve, different from the engine control microcomputer.

Here, that at least one part of the control target opening setting section is composed of an arithmetic program means, for example, that the target opening correction quantity operation section can be constructed as a map that a relationship between differences and target opening correction quantities is memorized beforehand in a memory, or a timer is constructed as hardware construction.

Preferably, the previously mentioned control target opening operation section sets a reference target opening as a control target opening when any one of a difference between a real opening and a reference target opening, an overshoot quantity of a real opening to the reference target opening, and a difference between a corrected target opening and a real opening reaches a predetermined value or more.

BEST MODE FOR PRACTICING THE INVENTION

Figure 1:
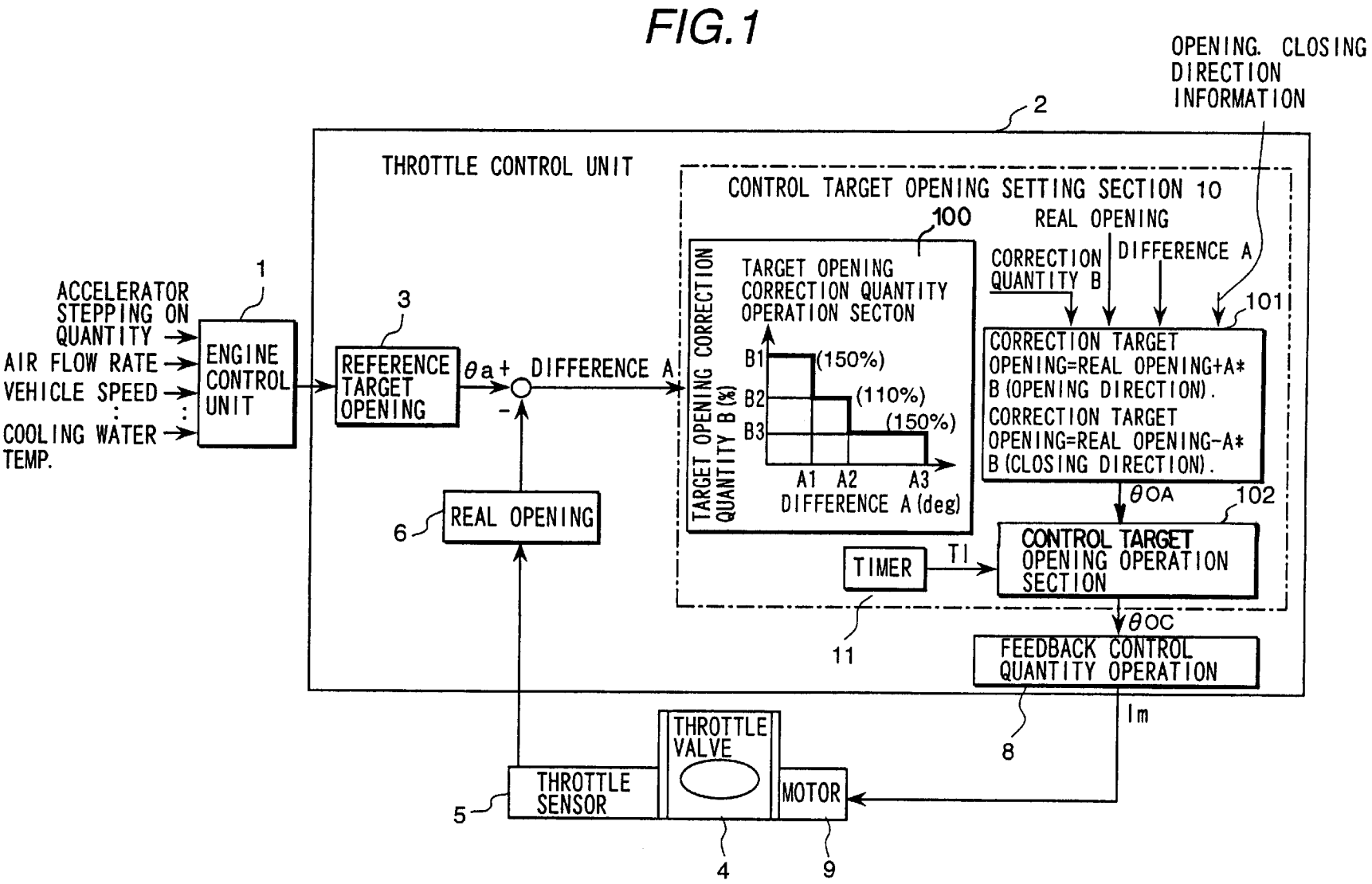
FIG. 1 is a schematic view showing an embodiment of the present invention.

Embodiments of the present invention will be explained hereunder, referring to the drawings.

FIG. 1 shows a schematic construction of an embodiment of the present invention. A control apparatus of a throttle valve of an engine, shown in FIG. 1 is composed of an engine control unit 1 and a throttle control unit 2. A reference target opening 3 is given from the engine control unit 1 to the throttle control unit 2. An operation of an actuator 4 for operating a throttle valve (not shown) is detected by a throttle sensor 5, and inputted into the throttle control unit 2 as a real opening 6 of the throttle valve. The above-mentioned reference target opening 3 and the real opening 6 are compared, and a target opening $\theta_{\alpha A}$ is set which is corrected according to a difference between the reference target opening 3 and the real opening 6, as described later. Feedback control quantity operation 8 is executed on the basis of the corrected target opening $\theta_{\alpha A}$ and a motor 9 of the actuator 4 is driven, based on its output. As a result, an opening of the throttle valve is controlled according to the corrected target opening.

Figure 2:
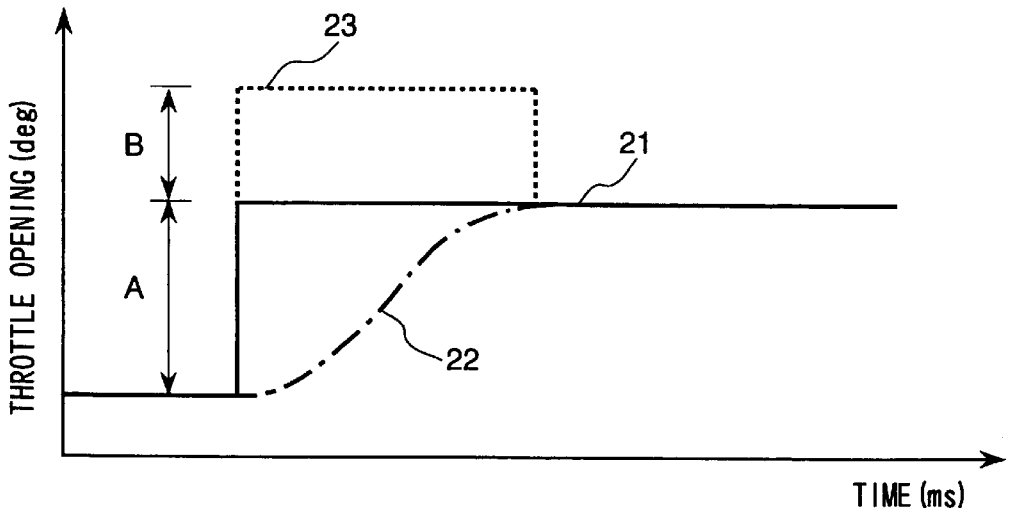
FIG. 2 is a view showing a conception of the present invention.

FIG. 2 shows a relationship between target openings and corrected target openings.

To the reference target opening 21 received from the engine control unit, a corrected target opening 23 is set in the following relation, the corrected target opening=a real opening+a difference×a correction quantity, using a target opening correction factor determined according to a difference between the real opening 22 and the reference target opening 21, that is, a correction quantity B. Then, in time period until termination is judged, the target opening 23 corrected as shown in FIG. 2 according to a magnitude of difference gradually decreases (stepwise).

Figure 3:
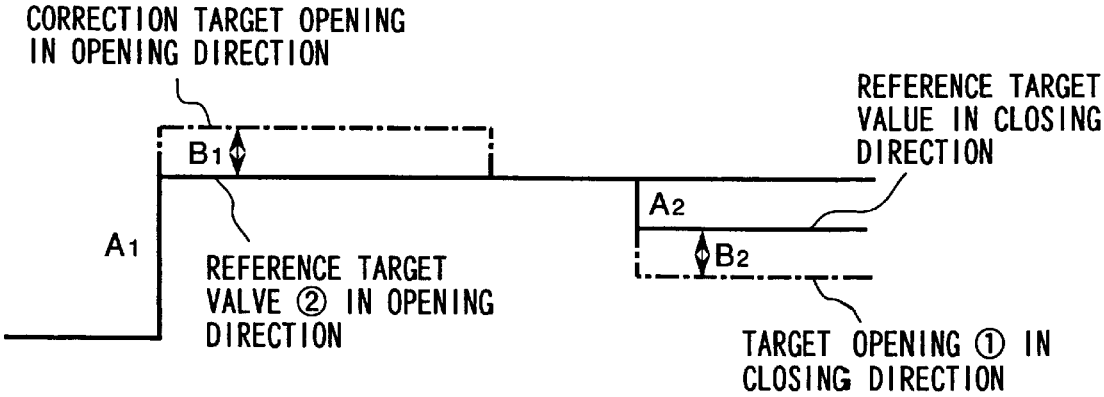
FIG. 3 is a view explaining setting of correction target opening.

FIG. 3 is an illustration for explaining setting of the corrected target opening. As for the setting of the corrected target opening, not only the setting in an opening direction but also setting in a closing direction is effected, as shown in FIG. 3. Which of the setting to be taken is determined on the basis of the history of the reference target opening.

Figure 4:
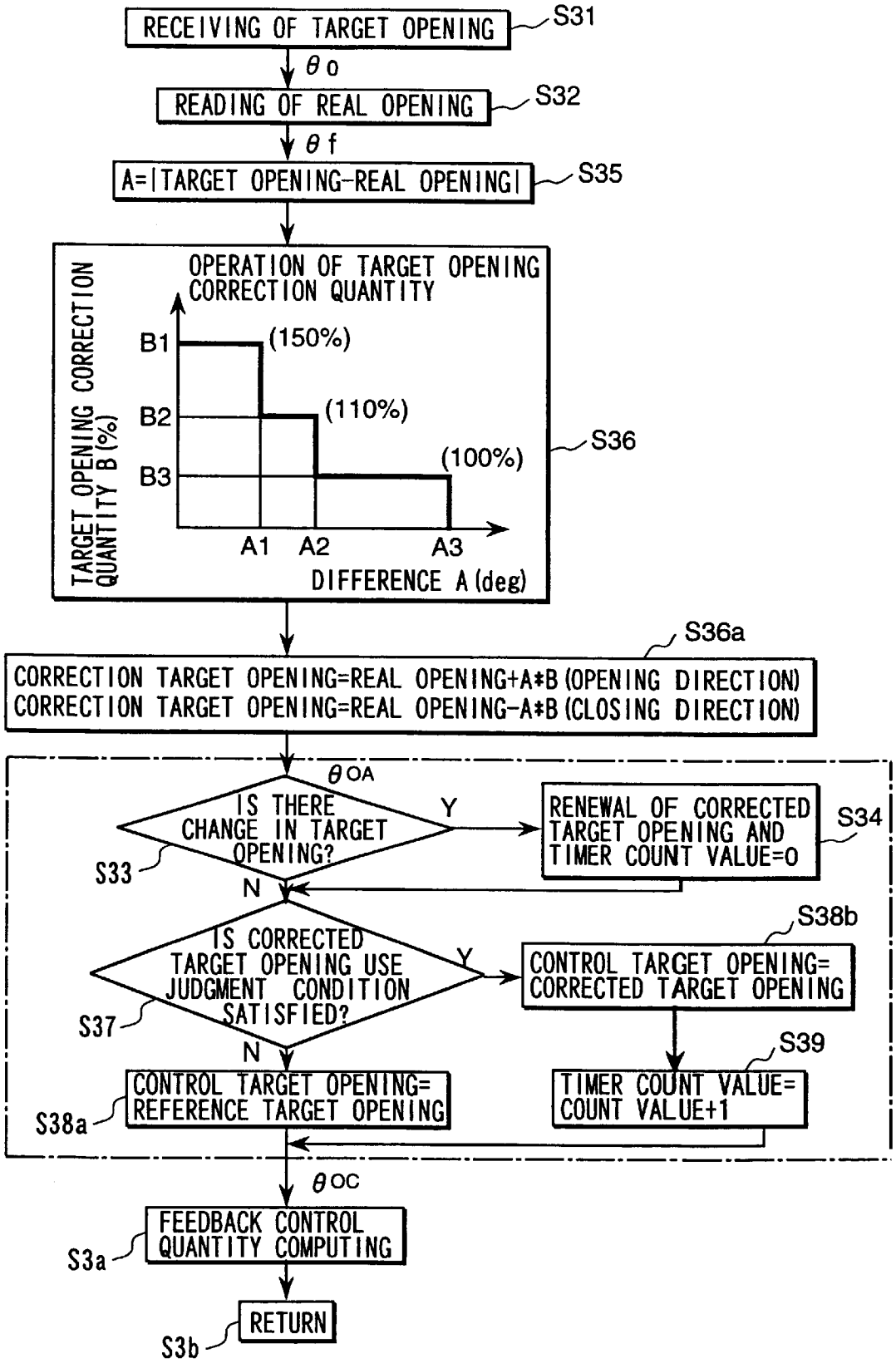
FIG. 4 is a flow chart showing a setting procedure of correction target opening.

FIG. 4 is a flow chart showing a procedure for setting the corrected target opening.

In FIG. 4, first, a reference target opening $\theta_o$ is received from the engine control unit 1 (step S31), then, a real opening $\theta_f$ is read in (step S32). Next, a difference A between the target opening (S31) and the real opening (S32) is computed (step S35).

Then, the processing proceeds to the target opening correction operation section 100 shown in FIG. 1. In step S36, a target opening correction quantity B is obtained on the basis of the difference A, by using the map or by computing. The target opening correction quantity B is set such that the smaller the difference, the larger the value to be set such as 150%, whereby the corrected target opening can be made large. Thereby, a computing value of a feedback control quantity can be made large.

Then, the processing proceeds to the corrected target opening operation section 101 shown in FIG. 1, and the corrected target opening is set on the basis of a prescribed equation shown in FIG. 4 (step S36*a*).

Successively, the processing proceeds to the control target opening operation section 102 shown in FIG. 1, and it is judged whether or not there is no change in the target opening during setting the corrected target opening (step S33). In the case of "YES", the counter is initialized, and the corrected target opening is renewed (step S34). The processing proceeds from step 34 to step S37. In the case of "NO", the processing directly proceeds from the step 33 to step 37, and judging conditions of use of the corrected target opening, that is, whether or not the corrected target opening is used, is judged here. When the judgement result in the step S37 is "YES", the control target opening is set the corrected target opening (step S38*b*) and 1 is added to a count value of the timer. Then, the processing proceeds to step 3*a*. If the judgement result of step S37 is "NO", the control target opening is set the reference target opening (step S38*a*). Then, the processing proceeds to the step S3*a*.

Next, in the step S3*a*, a feedback control quantity is computed using the obtained control target opening. Then, the processing reaches to step S3*b*.

Figure 5A:
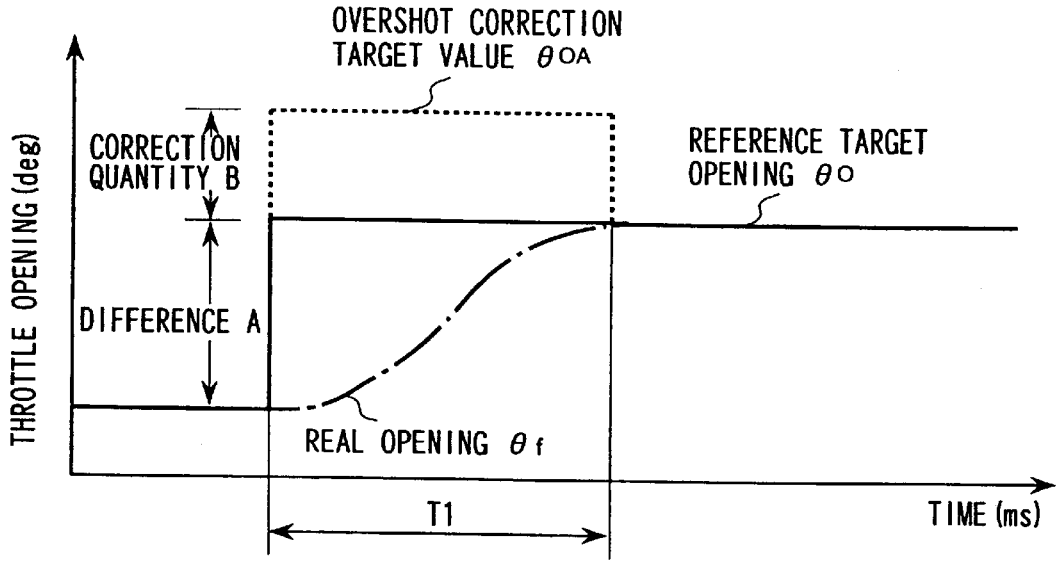
FIG. 5A, FIG. 5B and FIG. 5C, each are a view explaining judgement of termination.
Figure 5B:
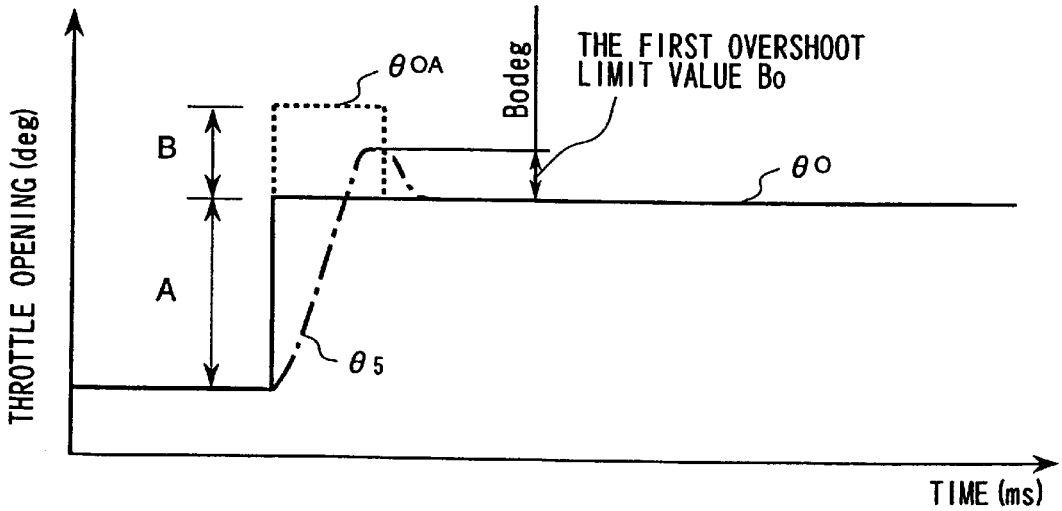
Figure 5C:
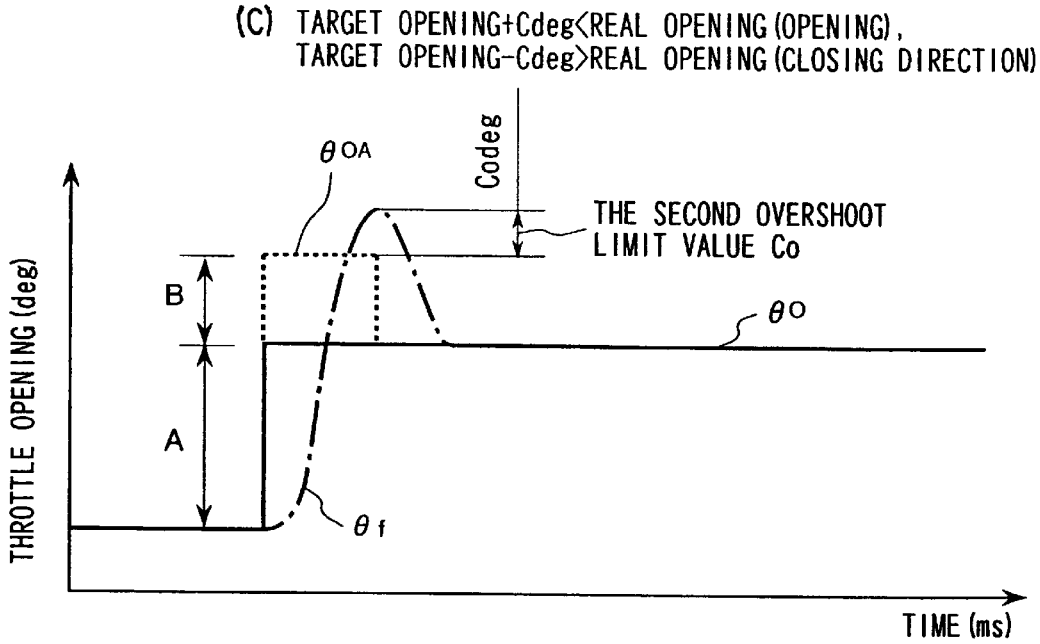
Figure 6:
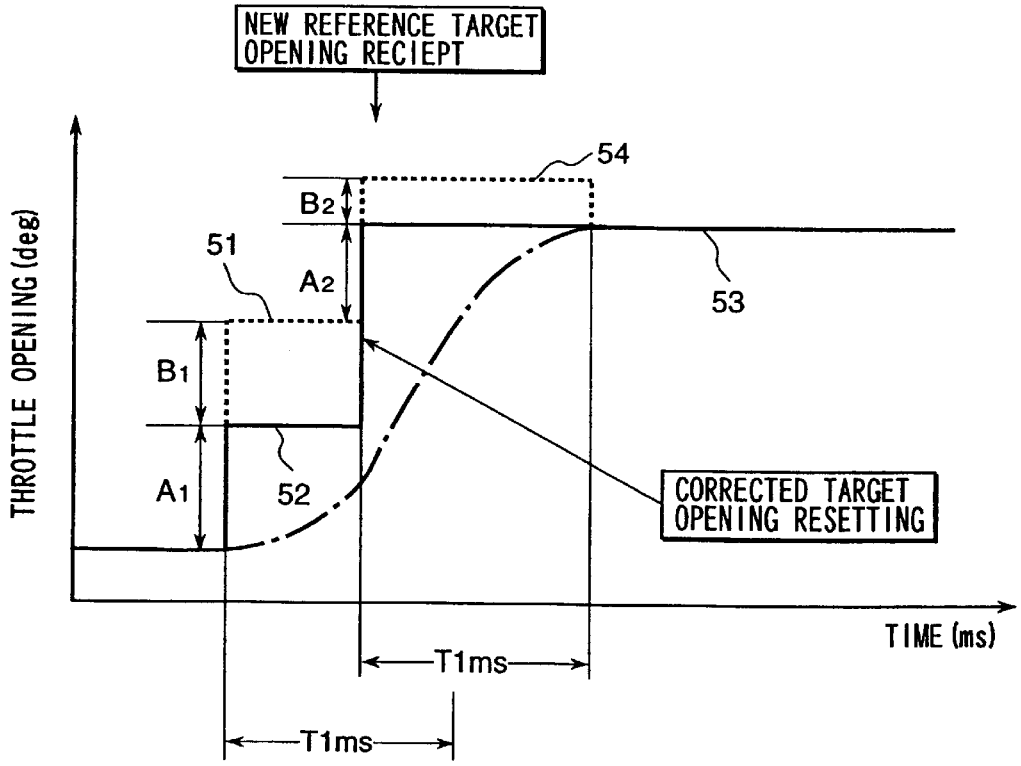
FIG. 6 is an explanation view for explaining judgement of canceling.
Figure 1:
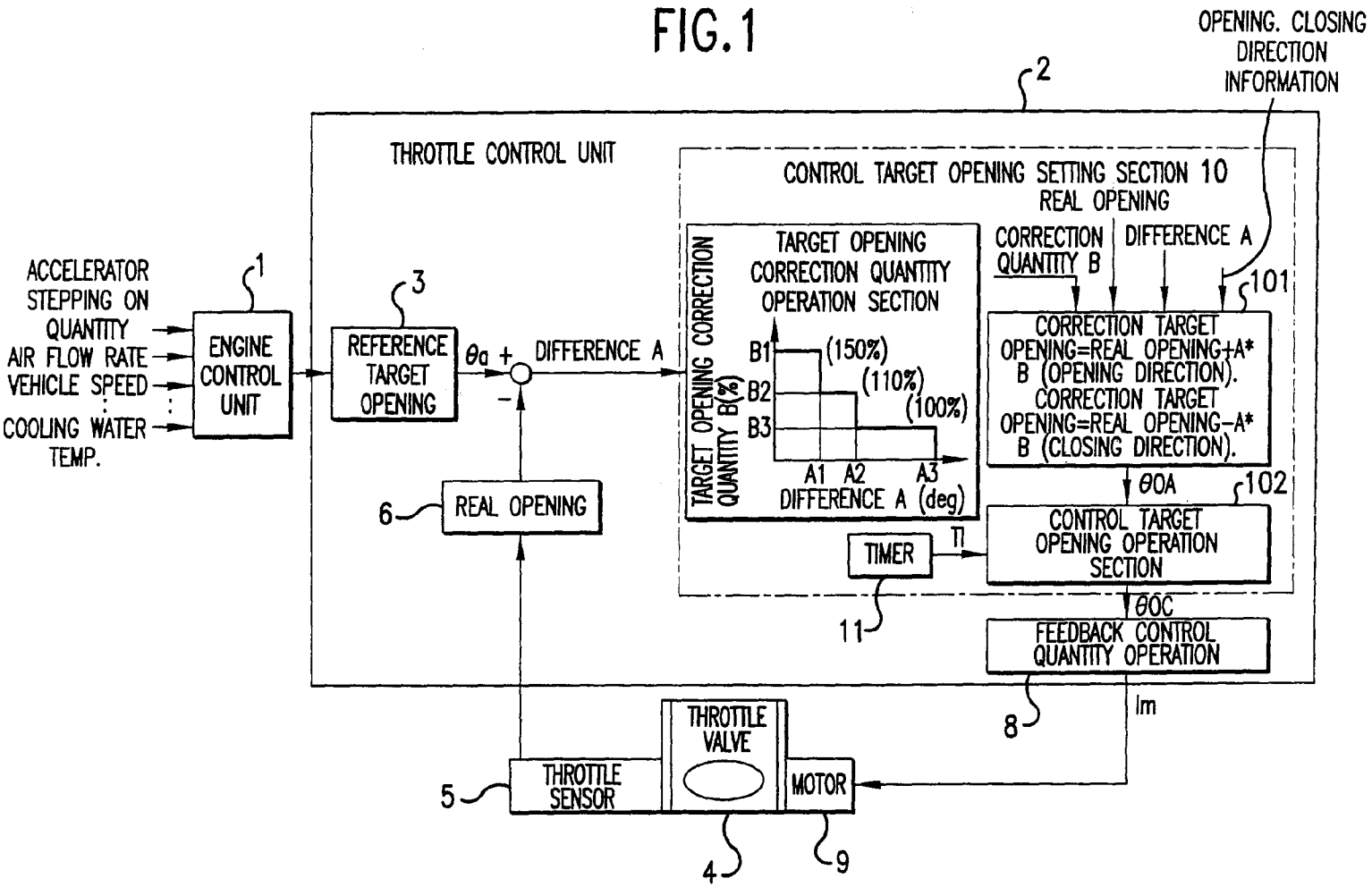

FIGS. 5A, 5B and 5C show termination judgement 10 of the corrected target opening control shown in FIG. 1, and FIG. 6 shows details of cancel judgement 11.

In FIGS. 5A, 5B and 5C, three cases (A), (B) and (C) of judgement of use of the target opening, or, taking it contrary, termination judgement of the target opening (in this case, "YES" and "NO" are contrary to ones described in Figures) are shown. FIG. 5A shows that the corrected target opening is brought into termination irrespective of convergence of the throttle opening to a target value in the case where time T1 ms or more has been passed after setting of the corrected target opening.

FIGS. 5B and 5C show termination conditions in the case where the condition of FIG. 5A is established and the throttle opening reached to the target opening before the processing is not stopped.

FIG. 5B shows that the corrected target opening terminates when a real opening exceeds the target opening by $B_o$ deg or more, and FIG. 5C shows that: the corrected target opening terminates when a real opening exceeds the target opening by $C_o$ deg or more. Those conditions are set for the case the throttle valve moves faster than it can be prospected.

FIG. 6 shows processing in the case a new target opening is received during practice of the corrected target opening program. A new target opening 53 was received during control by the corrected target opening set on the basis of a difference between the target opening 52 and a real opening. In this case, the current corrected target opening is canceled by the judgement of step S33 in the flow chart in FIG. 4, a new corrected target opening 54 is set and a feedback control quantity is computed on the basis thereof.

Further, at this time, simultaneously a termination condition is also set again, based on the new target opening 53.

The present invention also can be applied to such an apparatus that the engine control unit is provided functionally with both functions of the engine control unit and throttle control unit, and transmission of signals is effected by receiving and transmitting of signals of a computer of the engine control unit. Even in this case, the same control as the control shown in FIG. 1 can be effected by taking a signal of the sensor 5 (refer to FIG. 1) provided on the actuator 4 into the engine control unit.

As mentioned above, in the present invention, a real opening of the throttle valve is detected, and according to a difference between the real opening and a target opening from the engine control unit, the target opening is corrected, that is, so-called corrected target opening is set. And, by setting the corrected target opening to a large value, the throttle valve control can be made fast and the response is improved. Further, since the corrected target opening is used, throttle control of excellent response can be effected irrespective of secular change of an engine and throttle valve and variation of products, that is, difference in individuals.

Further, since the target opening use judgement (termination judgement) means or cancel judgement means are added, throttle control of high safety can be effected.

What is claimed is:

1. A control method of a throttle valve of an engine, comprising controlling an opening position of the throttle valve on the basis of a reference target opening of the throttle valve set according to conditions of the engine and a real opening of the throttle valve, comprising said reference target opening and said real opening obtaining a correction quantity for correcting said reference target opening corresponding to the difference obtained as a result of the comparison, and setting a target opening corrected to have a larger value than said reference target opening on the basis of the correction quantity, wherein a correction quantity of said dummy target opening is obtained as a value of said difference multiplied by a constant, and the constant is set a larger value as said difference becomes smaller.

2. A control method of a throttle valve of an engine according to claim 3, wherein the correction quantity of said target opening is reset in turn every time the reference target opening is changed, according to a difference between the real opening and the changed reference target opening.

3. A control method of a throttle valve of an engine according to claim 1, wherein when any one of a time having passed from the time the target opening is set, an overshoot quantity of said real opening to the reference target opening and a difference between the corrected target opening and the real opening reaches a predetermined value or more, said corrected target opening is set as the reference target opening.

4. A control method of a throttle valve of an engine according to claim 1, wherein when a reference target opening signal is changed to a new reference target opening signal during opening control based on said corrected target opening, said corrected target opening is canceled, a new corrected target opening is set based on a difference between the new reference target opening and a real opening.

5. A control method of a throttle valve of an engine according to claim 1, wherein said reference target opening is given from an engine control unit, and when said reference target opening changes, said corrected target opening is set.

6. A control method of a throttle valve of an engine, comprising controlling an opening position of the throttle valve on the basis of a reference target opening of the throttle valve set according to conditions of the engine and a real opening of the throttle valve, comprising said reference target opening and said real opening are compared, obtaining a correction quantity for correcting said reference target opening, corresponding to the difference obtained as a result of the comparison, and setting a target opening corrected to have a larger value than said reference target opening on the basis of the correction quantity, wherein a suitable correction quantity of said target opening is selected from a plurality of values predetermined according to a difference between the reference target opening and a real opening.

7. A control apparatus of a throttle valve of an engine, comprising a reference target opening setting section outputting an opening of said throttle valve set according to conditions of the engine a, a reference target opening, a real opening detecting section detecting and outputting a real opening position of said throttle valve, and a control target opening setting section computing a control target opening according to a difference between a reference target opening outputted by said reference target opening setting section and a real opening outputted by said real opening detecting section, wherein said control target opening setting section has a target opening correction quantity operation section computing a correction quantity for correcting said reference target opening according to a difference between the reference target opening and the real opening, wherein said control target opening setting section has a control target opening operation section for selecting a target opening as a control target opening or a reference target opening as a control target opening.

8. A control apparatus of a throttle valve of an engine according to claim 7, wherein at least one part of said control target opening setting section comprises an arithmetic program stored in a memory of a microcomputer for controlling the engine.

9. A control apparatus of a throttle valve of an engine according to claim 7, wherein at least one part of said control target opening setting section comprises an arithmetic program stored in a memory of a microcomputer for controlling said throttle valve different from said engine controlling microcomputer.

10. A control apparatus of a throttle valve of an engine according to claim 7, wherein said control target opening operation section sets said reference target opening as said control target opening when any one of a difference between said real opening and said reference target opening, an overshoot quantity of said real opening to said reference target opening, and a difference between said corrected target opening and said real opening reaches a predetermined value or more.

11. A control apparatus of a throttle valve of an engine, which is provided with a reference target opening setting section outputting an opening of said throttle valve set according to conditions of the engine as a reference target opening, a real opening detecting section detecting a real opening position of said throttle valve and outputting it, and a control target opening setting section computing a control target opening according to a difference between a reference target opening outputted by said reference target opening setting section and a real opening outputted by said real opening detecting section, wherein said control target opening setting section has a target opening correction quantity operation section computing a correction quantity for correcting said reference target opening according to a difference between the reference target opening and the real opening, wherein said correction quantity is obtained as a value of said difference multiplied by a constant, and said constant is set a larger value as said difference becomes smaller.

12. A control apparatus of a throttle valve of an engine according to claim 13, wherein at least one part of said control target opening setting section comprises an arithmetic program stored in a memory of a microcomputer for controlling said throttle vale different from said engine controlling microcomputer.

13. A throttle apparatus provided with a throttle valve, the opening of said throttle valve being controlled by a motor, wherein the apparatus is configured such that a response speed for opening and closing of said throttle valve when a change of an opening of said throttle valve is large is substantially the same as a response speed for opening and closing of said throttle valve when the opening change is small.

14. A control method of a throttle valve of an internal combustion engine, comprising controlling an opening position of said throttle valve according to a difference between a target opening and a real opening of said throttle valve by adding a correction quantity based on said difference to said target opening, and increasing a rate of said correction quantity to said target opening when said difference is smaller rather than when larger.

* * * * *

UNITED STATES PATENT AND TRADEMARK OFFICE

CERTIFICATE OF CORRECTION

PATENT NO. : 6,302,084 B1
DATED : October 16, 2001
INVENTOR(S) : Yasuhiro Kamimura et al.

It is certified that error appears in the above-identified patent and that said Letters Patent is hereby corrected as shown below:

Drawings,

The title page, showing the illustrative figure should be replaced with the attached title page.

Sheet 1 or 5, consisting of Figure 1, should be deleted and substitute therefor with the corrected Figure 1, as shown on the attached page.

Signed and Sealed this

Eighteenth Day of June, 2002

*Attest:*

*Attesting Officer*

JAMES E. ROGAN
*Director of the United States Patent and Trademark Office*

(12) United States Patent
Kamimura et al.

(10) Patent No.: US 6,302,084 B1
(45) Date of Patent: Oct. 16, 2001

(54) METHOD OF CONTROLLING THROTTLE VALVE OF ENGINE AND CONTROLLER

(75) Inventors: Yasuhiro Kamimura, Hitachinaka; Yasushi Sasaki, Urizura-machi; Norio Tomita, Hitachinaka, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/446,946

(22) PCT Filed: Apr. 14, 1999

(86) PCT No.: PCT/JP99/01988

§ 371 Date: Dec. 30, 1999

§ 102(e) Date: Dec. 30, 1999

(87) PCT Pub. No.: WO99/53182

PCT Pub. Date: Oct. 21, 1999

(30) Foreign Application Priority Data

Apr. 14, 1998 (JP) ..... 10-103109

(51) Int. Cl.[7] ..... F02D 9/02; F02D 9/10
(52) U.S. Cl. ..... 123/399; 123/361
(58) Field of Search ..... 123/399, 361

(56) References Cited

U.S. PATENT DOCUMENTS 6,034,500 * 3/2000 Nagase et al. ..... 123/399
6,123,056 * 9/2000 Shimada et al. ..... 123/399
6,152,108 * 11/2000 Adachi et al. ..... 123/399

FOREIGN PATENT DOCUMENTS 56-37414 8/1981 (JP) .
58-133447 8/1983 (JP) .
07-97959 4/1995 (JP) .
7-332136 12/1995 (JP) .
8-144820 6/1996 (JP) .
9-317538 12/1997 (JP) .
10-47135 2/1998 (JP) .
10-89140 4/1998 (JP) .

* cited by examiner

*Primary Examiner*—Erick Solis
(74) *Attorney, Agent, or Firm*—Crowell & Moring LLP

(57) ABSTRACT

A throttle valve control apparatus of an engine is constructed so that the poorer the response of the throttle valve, the larger the value of a control signal given as a control signal for opening of the throttle valve, whereby the speediness of control and response of the throttle valve are improved. The engine throttle valve control apparatus has means for comparing a target opening which is a control target of the throttle valve and a real opening which obtained by a sensor or the like, and obtaining a corrected target opening of the throttle valve by a map or computing, corresponding to a difference obtained as the result of the comparison.

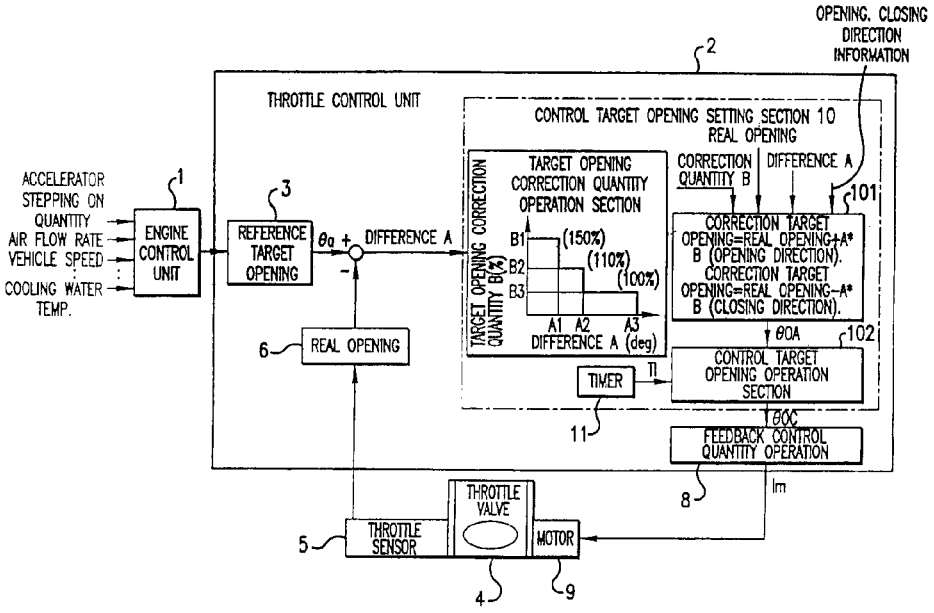

14 Claims, 5 Drawing Sheets